US007458503B2

(12) United States Patent
Fry

(10) Patent No.: US 7,458,503 B2
(45) Date of Patent: Dec. 2, 2008

(54) SELF-LOCKING STACKABLE TAPERED CONTAINER WITH PARTIAL TOP STRUCTURE

(75) Inventor: Stanley L Fry, West Covina, CA (US)

(73) Assignee: International Paper Company, Loveland, OH (US)

( * ) Notice: Subject to any disclaimer, the term of this patent is extended or adjusted under 35 U.S.C. 154(b) by 0 days.

(21) Appl. No.: 11/881,108

(22) Filed: Jul. 25, 2007

(65) Prior Publication Data

US 2007/0267470 A1 Nov. 22, 2007

Related U.S. Application Data

(62) Division of application No. 11/788,381, filed on Apr. 19, 2007, which is a division of application No. 10/672,428, filed on Sep. 26, 2003, now Pat. No. 7,207,473.

(60) Provisional application No. 60/414,099, filed on Sep. 27, 2002.

(51) Int. Cl.
*B65D 5/20* (2006.01)
*B65D 21/032* (2006.01)

(52) U.S. Cl. ..... 229/174; 229/177; 229/178; 229/179; 229/918

(58) Field of Classification Search ..... 229/112, 229/170, 916; 206/509
See application file for complete search history.

(56) References Cited

U.S. PATENT DOCUMENTS 2,076,018 A 4/1937 Ferguson
2,572,610 A 10/1951 Gilbert
2,657,849 A 11/1953 Paul et al.
3,036,753 A 5/1962 Davis et al.
3,547,337 A 12/1970 Pisarczuk
3,871,570 A 3/1975 Garmon
4,082,215 A 4/1978 Eichenauer
4,134,533 A 1/1979 Heavner
4,600,142 A 7/1986 Quaintance
4,770,339 A * 9/1988 Weimer ..... 206/509
5,255,841 A 10/1993 Ritter
5,294,044 A 3/1994 Clark
5,860,590 A 1/1999 Blomfield et al.
6,131,805 A 10/2000 Gasior
6,270,009 B1 8/2001 Heeren
6,296,178 B1 10/2001 McKenna, Sr.
6,443,358 B1 * 9/2002 Schilling ..... 206/509
6,460,758 B1 10/2002 Fenton et al.
6,481,619 B1 11/2002 Jackson
6,508,395 B2 1/2003 McLeod
6,568,588 B2 5/2003 Holdsworth et al.
6,641,032 B1 11/2003 Schilling
6,712,214 B1 * 3/2004 Wintermute et al. ..... 206/509
6,889,893 B2 5/2005 Kent
2003/0038051 A1 2/2003 Bennett et al.
2004/0211824 A1 * 10/2004 Conway ..... 229/167

* cited by examiner

*Primary Examiner*—Gary E Elkins
(74) *Attorney, Agent, or Firm*—Thomas W. Barnes, III

(57) ABSTRACT

A stackable container for carrying produce. The container has tapered side walls or end walls to aid in the stacking of like containers. Also, the container has locking flaps that allow the container to be erected manually and without the need for fasteners. Further, at least one tapered wall of the container has a reinforcement flap that creates a partial top structure in the upper part of the container that helps prevent bulging of the walls. The reinforcement flap also creates doubled stacking tabs and diagonal corner posts that aid in the stacking of like containers.

13 Claims, 7 Drawing Sheets

SELF-LOCKING STACKABLE TAPERED CONTAINER WITH PARTIAL TOP STRUCTURE

PRIORITY CLAIM

This application claims priority from U.S. Provisional Application Ser. No. 60/414,099 filed Sep. 27, 2002, the disclosures of which are incorporated herein by reference.

FIELD OF THE INVENTION

The present invention relates to a container made of a flexible material, erected from a unitary paperboard blank (hereafter, "blank"), for the holding, stacking and transporting of various items such as agricultural produce. In particular, the present invention relates to a container having self-locking side or end walls, tapered opposing side or end walls, tab locking assemblies scored and cut in a base panel of the container for accepting and securing the tabs of an adjacently stacked container, and a reinforcement flap forming a partial top structure having doubled stacking tabs and corner posts.

BACKGROUND OF THE INVENTION

Corrugated paperboard is typically used in many different applications, for example, to form containers, boxes, cartons, or dividers for holding, storing, stacking or shipping various items such as agricultural produce. Recent produce packaging trends have developed for retail markets in open-top retail ready trays (sometimes referred to as tee trays), which allow consumers to purchase various produce items when displayed such open topped containers. Typically, such containers have a bottom and four side walls, and are formed from a blank scored with score lines or cut lines. The blanks are most often formed by automated machines in a continuous in-line process involving cutting, scoring and molding continuous sheets of paperboard. The paperboard is then folded along the score lines or cut lines to form a container. The blanks may be folded into a tray by an automated machine or by a consumer.

During use, containers are often stacked on top of one another for ease of shipping and for optimum use of space. In these circumstances, it is possible for containers to have stacking tabs extending upward from the top edge of the container's side walls. These stacking tabs often fit into corresponding notches cut into an adjacently stacked container to help secure the stack. Since containers are usually stacked on top of like sized containers, the stacking tabs that extend upward from a lower container's side walls position directly into the side walls of a higher, adjacent container. Thus, to accommodate the lower container's tabs, a complimentary notch must be cut out of the higher container's side walls. However, a notch in a side wall is problematic in that it does not secure the stacking tab on all four sides. Thus, these sidewall notches do not fully prevent side-to-side movement, subjecting the stack to potential toppling. This is sometimes circumvented by having a multi-ply side wall, wherein a stacking tab extends upwards from an inner layer of the side wall, thereby aligning the stacking tabs with the bottom panel of an adjacent container as opposed to the side wall. This, however, required excess paperboard to be used to create the multi-layer side wall and related excess costs.

Further, it is easy to misplace a container during stacking such that a higher container falls into a lower container, usually on an angle, potentially damaging the contents of the lower container. To solve this, several prior art containers have devised tapered side walls, wherein the distance between the top edges of the side walls is less than the distance between the lower edges of the side walls. This eases stacking by severely limiting the probability of the higher container falling into a lower container (hereafter, "sub-adjacent container"), since the narrower upper portion creates a more functional ledge for the base of the higher container (hereafter, "super-adjacent container") to rest on. However, with these containers, the tapered side walls do not have stacking tabs, severely lessening the strength of the stack.

Other prior art containers seek to solve the foregoing problems using fold-down panels or additional side walls or panels that create gussets or corner posts and/or double layer stacking tabs. See, e.g., U.S. Pat. No. 5,860,590 to Blomfield et al., U.S. Pat. No. 6,131,805 to Gasior, and U.S. Pat. No. 6,508,395 to McLeod. However, each has a problem in utilization that makes it relatively unattractive to manufacture or use. For example, some containers require the use of a full-sized panel that requires excessive materials thereby raising costs. Some require complicated procedures to assemble the container. Others require a machine to assemble the container, making such containers expensive to use. Yet others require fasteners such as staples or glue for assembly, which in addition to raising costs, makes it difficult to disassemble the container for storage and re-use without damaging the container. Accordingly, it is a broad object of the present invention to provide a cost-efficient container that is easy to assemble and disassemble and which has multiple features that allow it to be easily stacked with other containers to form a container stack that is stable and which minimizes damages to the containers in the stack.

SUMMARY OF THE INVENTION

In the present invention, the foregoing purposes, as well as others that will be apparent, are achieved generally by providing a container comprising a base panel, two opposing side walls and two opposing end walls. The container's side walls or end walls are tapered such that the angle between the side walls or end walls and the base panel is less than 90°. The container has locking flaps on the non-tapered end or side walls that allow the container to be erected manually and without the need for fasteners. Preferably, the container has at least one tapered side or end wall with a reinforcement flap. The reinforcement flap creates a partial top structure in the upper part of container that helps prevent bulging of the walls. The reinforcement flap also creates a doubled stacking tab which projects from the top of the container and which follows the taper of the adjacent side or end wall. In addition, the reinforcement flap creates diagonal corner posts along the corners of the container.

The container may have a window on at least one side wall to provide ventilation and/or viewing of the contents. Reinforcement pieces that are similar to and which function in the same manner as reinforcement flaps may be positioned on each side of the window. Openings may also be provided on the side or end walls to serve as handholds for carrying the container. In addition, one or more stacking tabs may be positioned along an upper edge of a side or end wall not having a doubled stacking tab. In a preferred embodiment of the present invention, the container has tab lock assemblies scored and cut in the base panel of the container and crushed areas, which coact to hold and keep in place the stacking tabs projecting from a sub-adjacent container. Further, in a preferred embodiment, lock tabs project from the corner post to fit into a lock slot in an adjacent locking flap and bottom tabs project from the bottom end of an end flap or side flap to fit into tab slots in the base panel.

The tapered side or end walls of the container and the tapered doubled stacking tabs ensure that the doubled stacking tabs fit into slots cut from the base panel, and not the side or end walls, of a super-adjacent container, thereby allowing the containers to securely stack without requiring excess paperboard material. Further, the tapered side or end walls lessen the distance between the top edges of the side or end walls as opposed to the base of the side or end walls, thereby preventing unwanted slippage by providing a better supporting ledge for a container when it is stacked on top of another. The locking flaps allow the container to be easily assembled by hand and also allow the container to be easily disassembled for storage and re-use without damaging the container. The reinforcement flap is easy to use and requires a minimum of material, thereby lowering costs. The combination of the foregoing features results in a container that is cost-efficient, easy to assemble and disassemble, easy to stack, and which forms a container stack that is not prone to toppling or damaging a sub-adjacent container, without using excess material.

Other objects, embodiments, features and advantages of the present invention will be apparent when the description of a preferred embodiment of the invention is considered in conjunction with the annexed drawings, which should be construed in an illustrative and not limiting sense.

DESCRIPTION OF PREFERRED EMBODIMENTS

Figure 1:
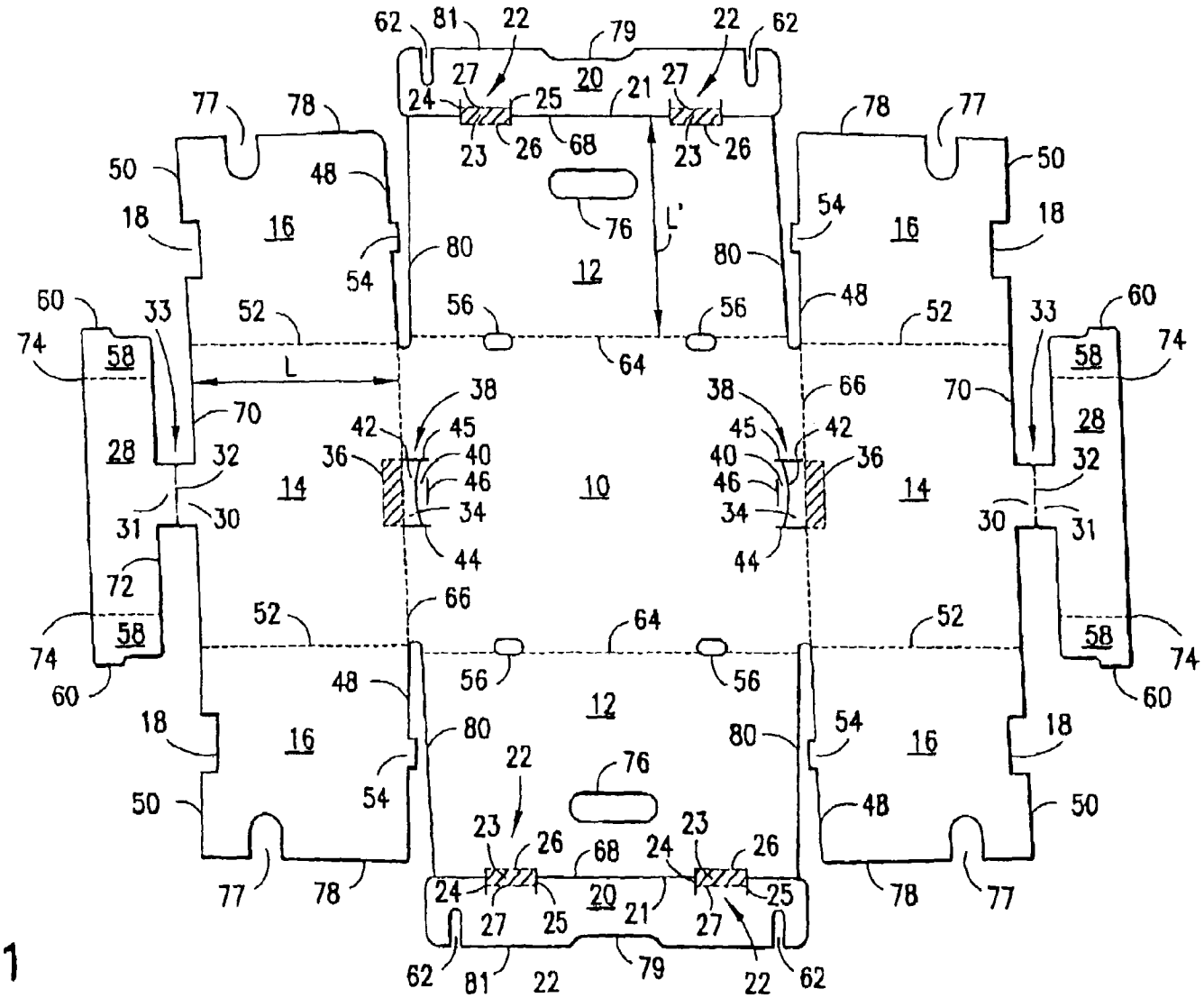
FIG. 1 is a plan view of a blank for a container according to one embodiment of the present invention.

A blank for a container embodying features of the present invention is shown in FIG. 1. The blank is scored for the purpose of folding into a container (i.e., a tee tray) suitable for holding, shipping or stacking a wide variety of objects, such as perishable agricultural products. The blank is preferably formed from flat corrugated paper, paperboard or such other material as known in the art as having suitable composition and thickness for the shipping and transporting of a wide variety of food items. For example, if one were to package heavier goods, a thicker grade of paperboard may be advisable.

Base panel 10 is substantially rectangular shaped and is bordered by end fold lines 66 and by side fold lines 64. Opposing end walls 14 foldably connect to the base panel 10 along fold lines 66 while opposing side walls 12 foldably connect to the base panel along fold lines 64. The end walls 14 are generally rectangular shaped and each end wall is bordered on four sides by an upper edge 70, fold line 66, and outer fold lines 52. The side walls 12 are substantially rectangular shaped and bordered by an upper edge 68, fold line 64 and side edges 80.

The end walls 14 have a width about equal to or less than the width of the upper edge 68 of the side walls 12. The length (arrow L) of the end walls 14 corresponds to the height of the end walls in an erected container. In the present example, the length of the end wall 14 and, consequently, the height of the end wall of the erected container is about 8 1/16 inches. However, the length (arrow L) of the end walls 14 and corresponding height of the end walls of the erected container can vary widely within the scope of the invention. The length (arrow L') of the side walls 12 corresponds to the height of the side walls of the erected container. Ideally the height of the side walls 12 is the same as the height of the end walls 14. Preferably, the width of the upper edge 68 of the side walls 12 are slightly less than the width of a bottom portion of the side walls adjacent to fold line 64. This is to accommodate the taper of the end walls 14 when the blank is erected to form the container (hereafter, "assembled"). Also, the side walls 12 may have an opening 76 that provides a handhold for carrying the erected container and which also allows for ventilation and viewing of the contents of the container.

End flaps 16 foldably attach to the end walls 14 along fold lines 52. The end flaps 16 are substantially rectangular shaped and bordered on four sides by a top edge 50, end edge 78, bottom edge 48, and fold lines 52. The upper edge 50 has a lock recess 18. Preferably, the end flap 16 has a bottom tab 54 projecting from the bottom edge 48. The bottom tab 54 is dimensioned to fit into a tab slot 56 disposed on the base panel 10 adjacent to fold line 64. As described in more detail below, when the blank is assembled, the lock recess 18 allows adjacent side walls 14 and end flaps 16 to be locked in place by a locking flap 28 (see below) while the bottom tab 54 and tab slot 56 fit together to hold the end flap 16 securely in place. The end flap may also have a recess 77 along the end edge 78, which registers with the opening 76 when the blank is assembled.

The bottom edge 48 of the end flaps extends generally in the same lateral plane as fold line 66 except that the bottom edge diverges from a bottom edge of the end wall 14 (i.e., fold line 66) with a slight angle towards the top edge 50, thereby causing the end walls 14 to taper inwards when the container is assembled. The angle of divergence of the bottom edge 48 can vary greatly, depending on how much of a taper is ultimately desired in the end walls. Similarly, top edge 50 extends generally in the same lateral plane as the upper edge 70 of the end wall 14, except that the top edge diverges away from the upper edge 70 at a slight divergent angle. The angle of divergence of the top edge 50 is preferably about the same as the angle of divergence of the bottom edge 48. For example, if bottom edge 48 diverges from fold line 66 at an angle of about 3°, then, the top edge 50 preferably diverges from the upper edge 70 at an angle of about 3°. The foregoing equivalent angle of divergence allows the upper edge 70 and top edge 50 to create a flat, even top corner when the container is assembled.

Locking flaps 20 are attached to the upper edges 68 of the side walls 12. The locking flaps 20 are hingeably connected to the upper edges 68 by a pair of spaced-apart lock hinge assemblies 22. The lock hinge assemblies 22 comprise a generally rectangular shaped hinge 23 bordered on the short sides by hinge cuts 24, 25 and on the long sides by fold lines 26, 27. The hinge 23 is sized, constructed, adapted and arranged (hereafter, collectively "dimensioned") to form fit into an adjacent lock recess 18 when the blank is assembled. The locking flaps 20 and hinge assemblies 22 hold adjacent side walls 14, end walls 14 and end flaps 16 in place when the blank is assembled. Also, the locking flap 20 may have a recess 79 along the outer edge 81 thereof. The recess 79 registers with the opening 76 when the blank is assembled. In a preferred embodiment, the locking flap 20 has a lock notch 62 disposed along the outer edge. The lock notch 62 is dimensioned to accept a lock tab 60 (see below) when the blank is assembled.

The hinge cuts 24, 25 are incisions that downwardly extend through the material comprising the locking flap 20 and side wall 12. One end of each hinge cut 24, 25 is perpendicular to a lower edge 21 of the locking flap and extends a short distance into the locking flap. The other end of each side cut 24, 25 is perpendicular to the upper edge 68 of the side wall 12 and extends a short distance into the side wall. The fold lines 26, 27 are perforations that extend downwardly through the material comprising the locking flap 20 and side wall 12 and are disposed perpendicular to and between the hinge cuts 24, 25. One fold line 26 is disposed on the side wall 12, parallel to the upper edge 68 of the side wall 12 and running perpendicularly between the hinge cuts 24, 25. The other fold line 27 is disposed on the locking flap 20, positioned parallel to the lower edge 21 of the locking flap and running perpendicularly between the hinge cuts 24, 25. The distance between the fold cuts 26, 27 is about equal to the thickness of the material comprising the end flaps 16 while the distance between the hinge cuts 24, 25 is about equal to the width of the lock recess 18. In an alternate embodiment (not shown), each fold line 26, 27 can be an single, short incision extending downwardly through the material comprising the side wall 12 locking flap 20 and locking flap 20 respectively.

A reinforcement flap 28 is foldably attached to the upper edges 70 of side walls 14. The reinforcement flap is substantially rectangular shaped having a width less than the width of the end wall 14 and a length considerably shorter than that of the end wall 14. The reinforcement flap 28 has small flaps or corner posts 58 that are foldably attached on fold lines 74 along the shorter ends of the reinforcement flap. In a preferred embodiment, the corner post 58 has a lock tab 60 projecting from a side edge thereof. The lock tab 60 is dimensioned to fit into the lock slot 62 (see above) when the blank is assembled to keep the locking flap 20 and reinforcement flap 28 in place. The reinforcement flap 28 is connected to the upper edge 70 of the end wall by a doubled stacking tab 33 (hereafter, "doubled tab"). The doubled tab 33 comprises a flap tab 31 extending from a tab edge 72 of the reinforcement flap 28 and an end wall tab 30 extending from the upper edge 70 of the end wall. The two tabs 31, 30 are foldably connected along tab fold line 32.

When the blank is assembled, the reinforcement flap 28 folds downwards and inwards along tab fold line 32 to form a partial top structure that reinforces the upper part of the container and prevents bulging. The folded down reinforcement flap 28 also positions the corner posts 58 diagonally across upper corners of the container to support a super-adjacent container while and the lock tabs 60 fold along fold line 74 extend into the lock slot 62 of an adjacent locking flap 20 to hold the corner post 58 in place. The folded down reinforcement flap 28 also positions the doubled tab 33 to project upwards and into a stacking slot of a super-adjacent container. In the embodiment shown in FIG. 1, the reinforcement flap 28 is connected to the upper edge 70 of the side wall 14 by only one doubled tab 33. However, it is to be understood that connecting the reinforcement flap 28 to the upper edge 70 with more than one doubled tab is within the spirit of the present invention.

In a preferred embodiment, tab lock assemblies 38 are cut and scored in the base panel 10 at a location adjacent to fold line 66 as shown in FIG. 1 or, alternatively, spaced slightly inward from the fold line 66. The tab lock assembly 38 comprises a stacking slot 34 and a flap tab 40. The stacking slot 34 and flap tab 40 are dimensioned and positioned to coact in accepting the doubled tab of a sub-adjacent container and hold the doubled tab in place.

The flap tab 40 has a length, width and thickness, wherein the thickness is equal to the thickness of the base panel 10, and the length and width can vary within the scope of the invention as long as the flap sufficiently engages a doubled tab to hold the doubled tab in place. The flap tab 40 is bordered by a contact edge 42, back cut 46, and a pair of opposing side cuts 44, 45. The contact edge 42 is the part of the flap tab 40 that engages and holds secure a doubled tab by rubbing against the doubled tab and holding it secure by friction fit. The contact edge 42 is disposed adjacent and parallel to the stacking slot 34 and is dimensioned to engage the doubled tab of a sub-adjacently stacked container when inserted through stacking slot 34, holding it securely in place. In the present embodiment, the contact edge 42 is a shaped in the form of a slightly tongue-shaped, outward extending arc. However, the shape of the contact edge 42 may be altered in other embodiments. For example, contact edge 42 can be shaped as a straight line.

The back cut 46 is positioned parallel to and at a distance from the contact edge 42 and perpendicular to and between side cuts 44, 45. The back cut 46 is a short incision extending downwardly through the entire thickness of the base panel 10. The back cut 46 allows the flap tab 40 to pivot up to hold secure the doubled tab. In the embodiment shown in FIG. 1, the ends of the back cut 46 does not extend from all the way between the side cuts 44, 45. However, in an alternate embodiment, the back cut 46 may be a perforated line running from all the way between the side cuts 44, 45.

The side cuts 44, 45 are incisions extending downwardly though the entire thickness of the base panel 10. The side cut lines 44, 45 extend, respectively, perpendicularly from each end of the contact edge 42 and partially into the base panel 10 for a distance, preferably, about equal to the distance between the back cut 46 and contact edge 42. The side cuts 44, 45 coact with the back cut 46 to enable the flap tab 40 to pivot upward about the back cut 46 without encountering undue resistance from the part of base panel 10 bordering the flap tab 40.

The stacking slot 34 is generally rectangular shaped and has a length about equal to the width of the doubled tab of a sub-adjacent container and a width slightly smaller than said doubled tab. This allows said doubled tab to extend through the stacking slot 34 and enabled the doubled tab to press against the flap tab 40, thereby causing the flap to bend upwards to accommodate and hold the doubled tab in place. The stacking slot 34 is positioned on the bottom panel 10 and is disposed between the flap tab 40 and fold line 66. Further, the stacking slot 34 is positioned to accept the doubled tab of the sub-adjacent container on a slight taper. If the degree of taper changes, the alignment can change accordingly. For example, if end walls of the sub-adjacent container taper a higher degree than the container shown in FIG. 1, the doubled tabs thereof will contact the base panel 10 of the super-adjacent container at some point closer to the center of base panel 10. To account for this, the stacking slots 34 can be inwardly spaced from fold line 66, thereby being aligned to accept said doubled tabs.

The end wall 14 may have a crushed area 36. The crushed area 36 is preferably rectangular shaped and is disposed adjacent to that part of the fold line 66 that is adjacent to the stacking slot 34. The crushed area 36 comprises a section of the end wall 14 that is pressed to a point wherein the thickness of the crushed area is less than the thickness of the end wall. The crushed area allows easier access of the doubled stacking tab of the sub-adjacent container into the stacking slot 34 in those embodiments wherein the taper of end wall of container is very slight.

The blank is erected manually to form the container as follows. The side walls 12 are folded upwards along fold lines 64. The end flaps 16 are upwards along fold lines 52 and the end walls 14 are then folded upwards to so that the bottom tabs 54 fits into adjacent tab slots 56 in the base panel 10. When this happens, bottom edge 48 aligns with fold line 64, thereby pulling down the end flaps and causing the end walls 14 to taper inwards. The taper of the end walls 14 may be slight, preferably between 1-5°, although this can vary widely within the scope of the invention depending on the angle of divergence of bottom edge 48. The results of the taper is an angle less than 90° between the base panel 10 and the end walls 14.

The locking flaps 20 are then folded inwards to lie flush against an outer surface of adjacent end flaps 16, thereby sandwiching the adjacent end flaps 16 between the locking flap 20 and adjacent side wall 12. The inwards folding of the locking flap 20 also caused the hinges 33 to form fit (i.e., "lock") into adjacent lock recesses 18 to hold the adjacent side wall 12, end wall 14 and end flaps 16 in place. The reinforcement flaps 28 are then folded inwards along tab fold line 32 so the reinforcement flap is lies flush against an upper portion of an inner surface of an adjacent end wall. 14. Each corner post 58 then folds along fold line 74 so that the corner post extends diagonally from the reinforcement flap 28 to an adjacent locking flap 20. The lock tab 60 fits into an adjacent lock notch 62 to hold the reinforcement flap, locking flap and corner post in place. The inwards folding of the reinforcement flap 28 also causes the doubled tab 33 to project upwards from the end wall 14. Since the end wall 14 now tapers inwards, the doubled tabs 33 also tapers inwards.

The resulting container erected from the blank possesses several desirable qualities. First, the use of locking flaps obviates the need to use glues, staples or other fasteners in the construction of the container, thereby reducing costs. Further, the use of locking flaps instead of fasteners allows the container to be disassembled without damaging the container. Thus the container can be easily disassembled and stored for re-used, thereby promoting recycling and lowering costs. Also, the disassembled container (i.e., the blank) requires less storage space, thereby reducing storage costs. The combination of tapered walls, tapered doubled tabs and tab locking assemblies also makes it easier to stack and maintain the alignment of a stack of containers. Doubled tabs are also stronger and more resistant to damage (e.g., bending, crushing) than single tabs. Further, the corner post 58 creates an upper ledge that increases the sturdiness of a container stack by preventing a super-adjacent container from falling downward into the container. The partial top created by reinforcement flap 28 provides bulge resistance as well. Also, since the reinforcement flap 28 has a smaller length (i.e., height) than the end wall 14, less material is required and there is slightly more usable interior space in the container as compared to using a reinforcement flap having the same width (i.e., height) as the end wall.

Figure 2:
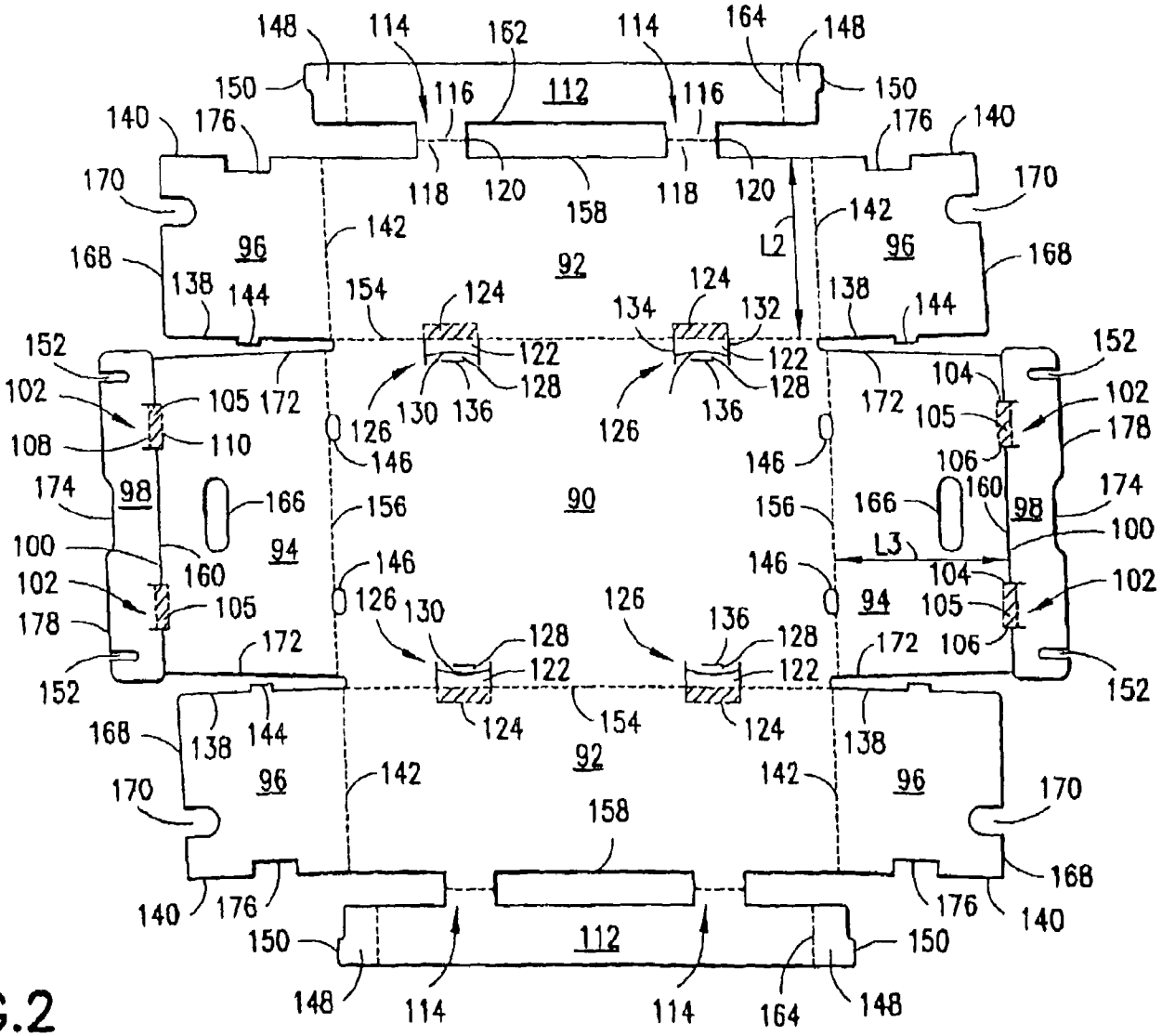
FIG. 2 is a plan view of a blank for a container according to another embodiment of the present invention.

FIG. 2 is a blank for another embodiment of a container embodying features of the present invention wherein the side walls are tapered, the locking flaps are positioned on the end walls and the reinforcement flaps are positioned on the side walls. Base panel 90 is substantially rectangular shaped and is bordered by end fold lines 156 and side fold lines 154. Opposing end walls 94 foldably connect to the base panel 90 along fold lines 156 while opposing side walls 92 foldably connect to the base panel along fold lines 154.

The end walls 94 are generally rectangular shaped. Each end wall is bordered on four sides by an upper edge 160, fold line 156, and side edges 172. The side walls 92 are substantially rectangular shaped and bordered by an upper edge 158, fold line 154 and fold lines 142. The side walls 92 have a width about equal to or greater than the width of the upper edge 160 of the end walls 94. The length (arrow L2) of the side walls 92 corresponds to the height of the side walls 92 in an erected container. In the present example, the length of the side wall 92 and, consequently, the height of the end wall of the erected container is about 8 1/16 inches. However, the length of the side walls 92 and corresponding height of the side walls of the erected container can vary widely within the scope of the invention. The length (arrow L3) of the end walls 94 corresponds to the height of the end walls of the erected container. Ideally the height of the end walls 94 is the same as the height of the side walls 92. Preferably, the width of the upper edge 160 of the end wall 94 is slightly less than the width of a bottom portion of the end wall adjacent to the fold line 156 to accommodate the taper of the side walls 92 when the blank is assembled. Also, the end walls 12 preferably have an opening 166 that is similar to and function largely in the same manner as opening 76 in FIG. 1.

Side flaps 96 foldably attach to each side wall 92 along fold lines 142. The side flaps 96 are similar to and function in largely the same manner as end flaps 16 in FIG. 1. The side flaps 96 are substantially rectangular shaped and bordered on four sides by a top edge 140, end edge 168, bottom edge 138, and fold line 142. The upper edge 140 has a lock recess 176. Preferably, the side flap 96 has a bottom tab 144 projecting from the bottom edge 138, the bottom tab 144 being dimensioned to fit into a flap tab slot 146 located on the base panel 90 adjacent to fold line 156. The side flap may also have a recess 170 along the end edge 168 thereof. The lock recess 176, bottom tab 144, tab slot 146 and recess 176 are similar to and function largely in the same manner as the lock recess 18, bottom tab 54, tab slot 56 and recess 77 in FIG. 1.

Similar to end flap 16, the bottom edge 138 of the side flaps 96 extends generally in the same lateral plane as fold line 154 except that the bottom edge diverges from a bottom edge of the side wall (i.e., fold line 154) with a slight angle towards the top edge 140, thereby causing the side walls 92 to taper inwards when the container is erected. The angle of divergence of the bottom edge 138 can vary greatly, depending on how much of a taper is ultimately desired in the side walls 92. Similarly, top edge 140 extends generally in the same lateral plane as the upper edge 158 of the side wall 92, except that the top edge diverges away from the upper edge 158 at a slight divergent angle. As in end flap 16, the angle of divergence of the top edge 140 is preferably about the same as the angle of divergence of the bottom edge 138 to allow the upper edge 140 and top edge 158 to create a flat, even top corner when the container is erected.

The locking flaps 98 are similar to and function in largely the same manner as the locking flaps 20 in FIG. 1. Locking flaps 98 are attached to the upper edges 160 of the end walls. The locking flaps 98 are hingeably connected to the upper edges 160 by a pair of spaced-apart lock hinge assemblies 102. The lock hinge assemblies 102 comprise a hinge 105 bordered by hinge cuts 104, 106 and fold lines 108, 110. The locking flap 98 may also have a recess 174 along an outer edge 178 thereof. Preferably, the locking flap 98 has a lock notch 152 along the outer edge 178 thereof. The hinge 105, hinge cuts 104, 106, fold lines 108, 110, recess 174 and lock notch 152 are similar to and function in largely the same manner as the hinge 23, hinge cuts 24, 25, fold lines 26, 27, recess 79 and lock notch 62 in FIG. 1.

One end of each hinge cut 104, 106 is perpendicular to a lower edge 100 of the locking flap 98 and extends a short distance into the locking flap. The other end of each hinge cut 104, 106 is perpendicular to the upper edge 160 of the end wall 94 and extends a short distance into the end wall 94. The fold lines 108, 110 are disposed perpendicular to and between the hinge cuts 104, 106. In an alternate embodiment, each fold line 108, 110 can be a single, short incision instead of perforations. One fold line 110 is disposed on the end wall 94, parallel to the upper edge 160 of the end wall and running perpendicularly between the hinge cuts 104, 106. The other fold line 108 is disposed on the locking flap 98 parallel to the lower edge 100 of the locking flap and running perpendicularly between the hinge cuts. The distance between the fold cuts 108, 110 is about equal to the thickness of the material comprising the side flaps 96 while the distance between the hinge cuts 104, 106 is about equal to the width of the lock recess 176.

The reinforcement flap 112 is foldably attached to the upper edges 158 of the side wall 92 and is similar to and functions in largely the same manner as the reinforcement flap 28 in FIG. 1. The reinforcement flap 112 is substantially rectangular shaped having a width less than the width of the side wall 92 and a length considerably shorter than that of the side walls. The reinforcement flap 112 has corner posts 148 foldably attached on fold lines 164 along the shorter ends of the reinforcement flap. Preferably, the corner post 148 has a lock tab 150 projecting from a side edge thereof. The corner post 148 and lock tab 150 are similar to and function in largely the same manner as the corner post 58 and lock tab 60 in FIG. 1.

The reinforcement flap 112 is connected to the upper edge 158 of the side wall 92 by a pair of spaced-apart doubled tabs 114. However, it is to be understood that a reinforcement flap connected to the upper edge by one or more that two doubled tabs is within the spirit of the present invention. The doubled tab 114 comprises a flap tab 116 extending from a tab edge 162 and a side wall tab 118 extending from the upper edge 158. The two tabs 116, 118 are foldably connected along tab fold 120. The doubled tab 114, flap tab 116, side wall tab 118 and tab fold 120 are similar to and function in largely the same manner as the doubled tab 33, flap tab 31, end wall tab 30 and tab fold 32 in FIG. 1.

In a preferred embodiment, tab lock assemblies 126 are cut and scored in the base panel 90 at a location adjacent to fold line 154 as shown in FIG. 2 or, alternatively, spaced slightly inward from the fold line 154. The tab lock assembly 126 comprises a stacking slot 122 and a tab flap 128. The tab flap 128 is bordered by a contact edge 130, back cut 136, and a pair of opposing side cuts 132, 134. The tab lock assembly 126, stacking slot 122, tab flap 128, contact edge 130, back cut 136, and side cuts 132, 134 are similar to and function in largely the same manner as the tab lock assembly 38, stacking slot 42, flap tab 40, contact edge 42, back cut 46, and side cuts 44, 45 in FIG. 1.

The stacking slot 122 is positioned on the bottom panel 90 and is disposed between the tab flap 128 and fold line 154. Further, the stacking slot 34 is positioned to accept the doubled tab of a sub-adjacent container on a slight taper. If the degree of taper changes, the alignment can change accordingly. For example, if side walls of the sub-adjacent container taper a higher degree than the container shown in FIG. 2, the doubled tabs thereof will contact the base panel 90 of the super-adjacent container at some point closer to the center of base panel 90. To account for this, the stacking slots 122 can be inwardly spaced from fold line 154, thereby being aligned to accept said doubled tabs.

The side wall 92 may have a crushed area 124 that is similar to and which functions in largely the same manner as the crushed area 36 of FIG. 1. The crushed area 124 is disposed adjacent to that part of the fold line 154 that is adjacent to the stacking slot 122. The crushed area allows easier access of the doubled stacking tab (not shown) of the sub-adjacent container into the stacking slot 34 in those embodiments wherein the taper of side wall of container is very slight.

The blank is erected manually to form the container in the largely the same manner as the blank of FIG. 1. The end walls 94 are folded upwards along fold lines 154. The side flaps 96 are upwardly along fold lines 142 and the side walls 92 are then folded upwards so that the bottom tabs 144 fit into adjacent tab slots 46 thereby aligning bottom edge 138 with fold line 156. This pulls down the side flaps, causing the side walls 92 to taper inwards. The taper of the side walls 92 may be slight, preferably between 1-5°, although this can vary widely within the scope of the invention. The results of the taper is an angle less than 90° between the base panel 90 and the side walls 92. As in the blank in FIG. 1, the locking flaps 20 are folded inwards to sandwich adjacent side flaps 96 between the locking flap 98 and an adjacent end wall 94 and also cause the hinges 105 to lock into adjacent lock recesses 176. The reinforcement flaps 28 are then folded inwards so that the reinforcement flap is lies flush against an upper portion of an inner surface of an adjacent side wall 92 and the doubled tabs 114 project upwards from the side wall 92. The corner posts 148 fold along fold line 164 so that the each corner post extends diagonally from the reinforcement flap 112 to an adjacent locking flap 98 and so that the lock tab 150 fits into an adjacent lock notch 152. Since the side wall 92 now tapers inwards, the doubled tabs 114 also taper inwards.

Figure 3:
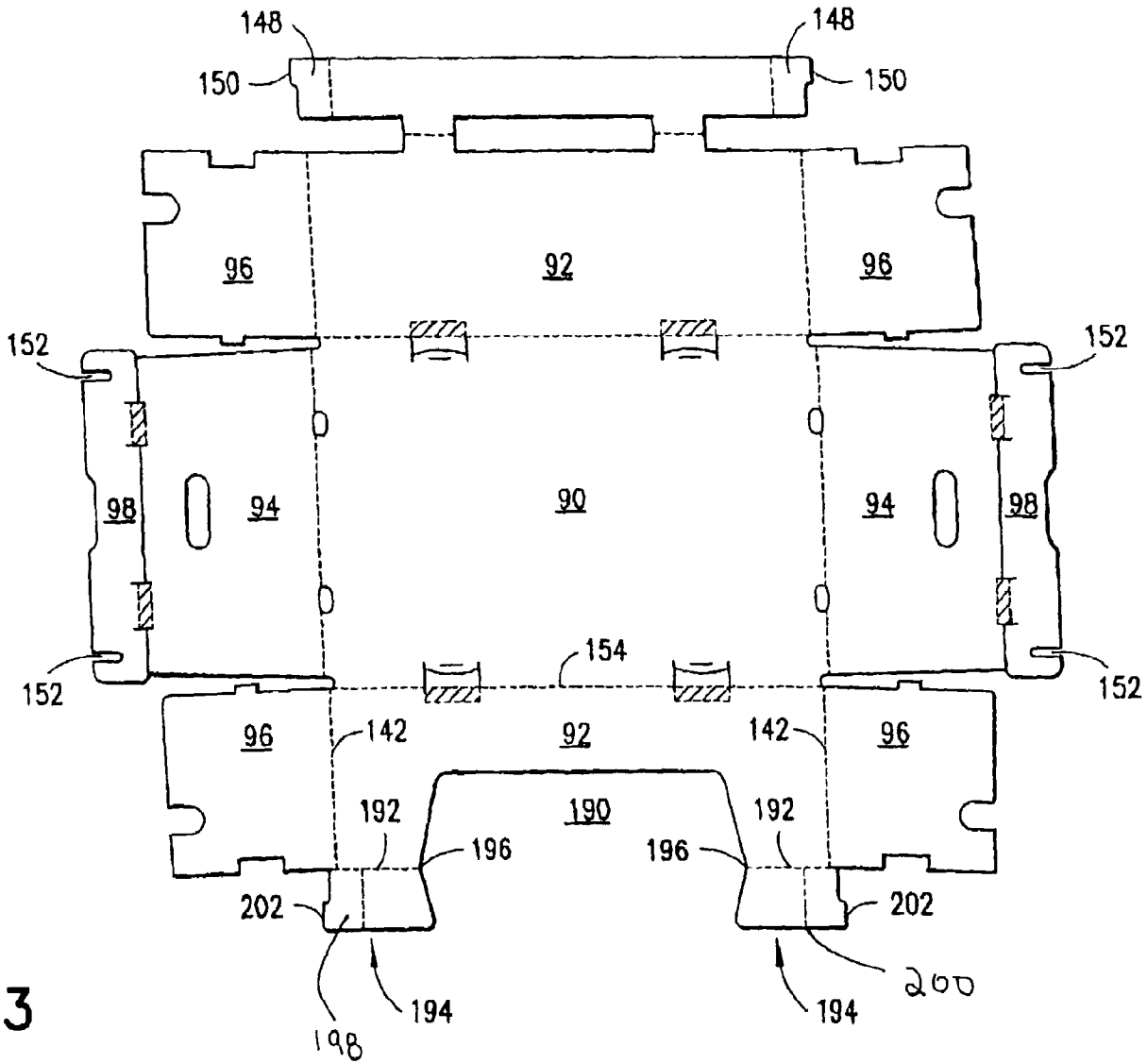
FIG. 3 is a plan view of a blank for an alternative embodiment of the container of FIG. 2.

FIG. 3 shows a blank for an alternative embodiment of the container of FIG. 2 wherein one a side wall has a window to provide visibility and a breathing hole for the items held within the container. As shown in FIG. 2, side wall 92' is substantially rectangular shaped and foldably connected to the base panel 90 along fold line 154'. The side wall 92' is bordered by an upper edge 192, fold line 154' and fold lines 142. The side wall 92' has a large, trapezoidal-shaped window recess 190 along the upper edge 192. In a preferred embodiment, side wall 92' may have reinforcement pieces 194. The reinforcement piece 194 is attached to upper edge 192 of the side wall 92' along a perforated fold line 196 which allows the reinforcement piece to fold over and lie flush against an inner surface of side wall 92'. The reinforcement piece 194 further has a corner post 198 foldably attached along fold line 200. The corner post 198 folds along fold line 200 and extends diagonally from the reinforcement piece 194 to an adjacent locking flap 98 when the blank is assembled, mirroring corner posts 148. The reinforcement piece may also have a lock tab 202 which is similar to and which functions in largely the same manner as lock tab 150. Specifically, the lock tab 202 fits into an adjacent lock notch 152 when the blank is assembled. The remainder of the blank in FIG. 3 is similar to and functions in largely the same manner as that of FIG. 2.

Figure 4:
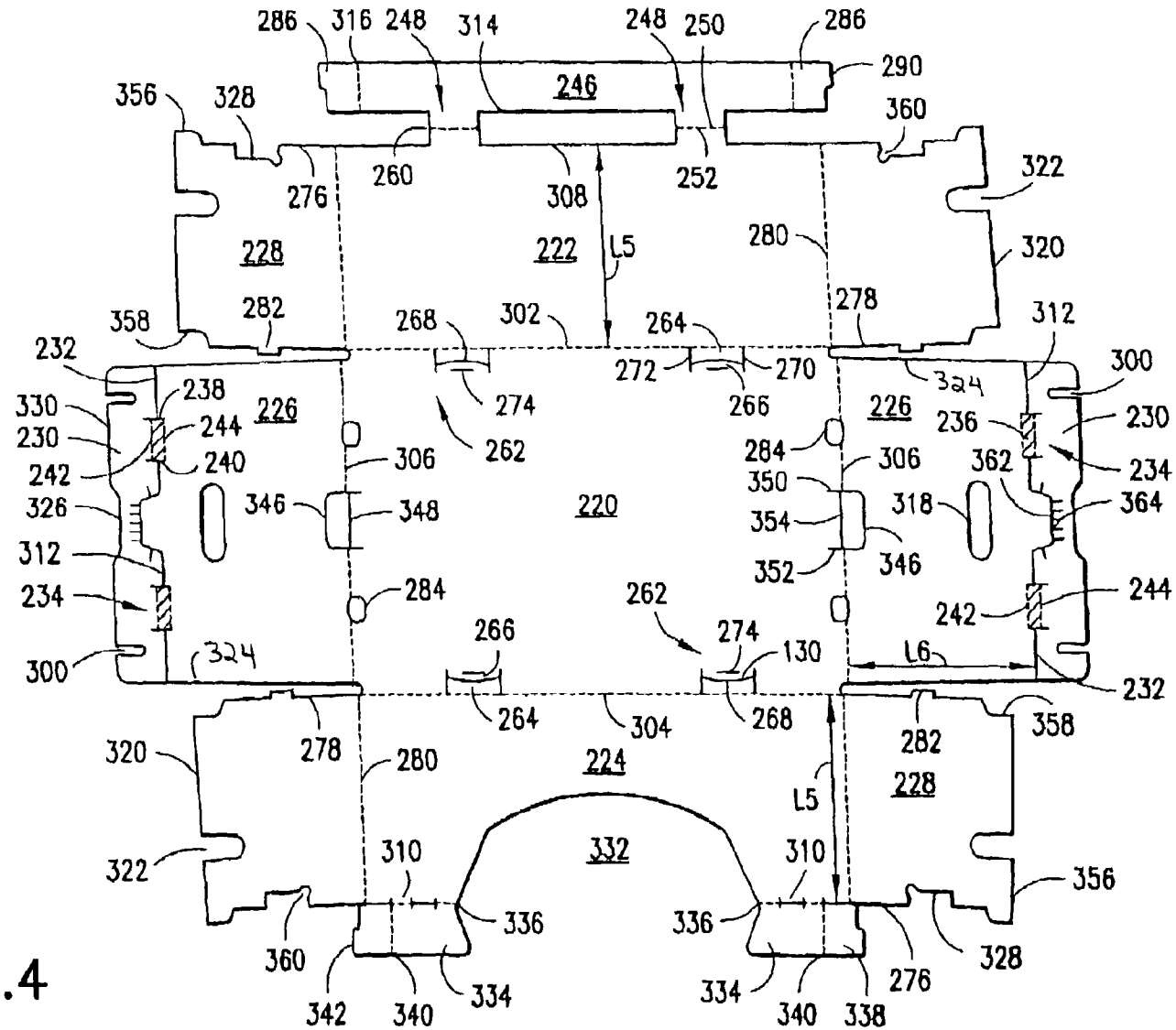
FIG. 4 is a plan view of a blank for an alternative embodiment of the container of FIG. 3.
Figure 7:
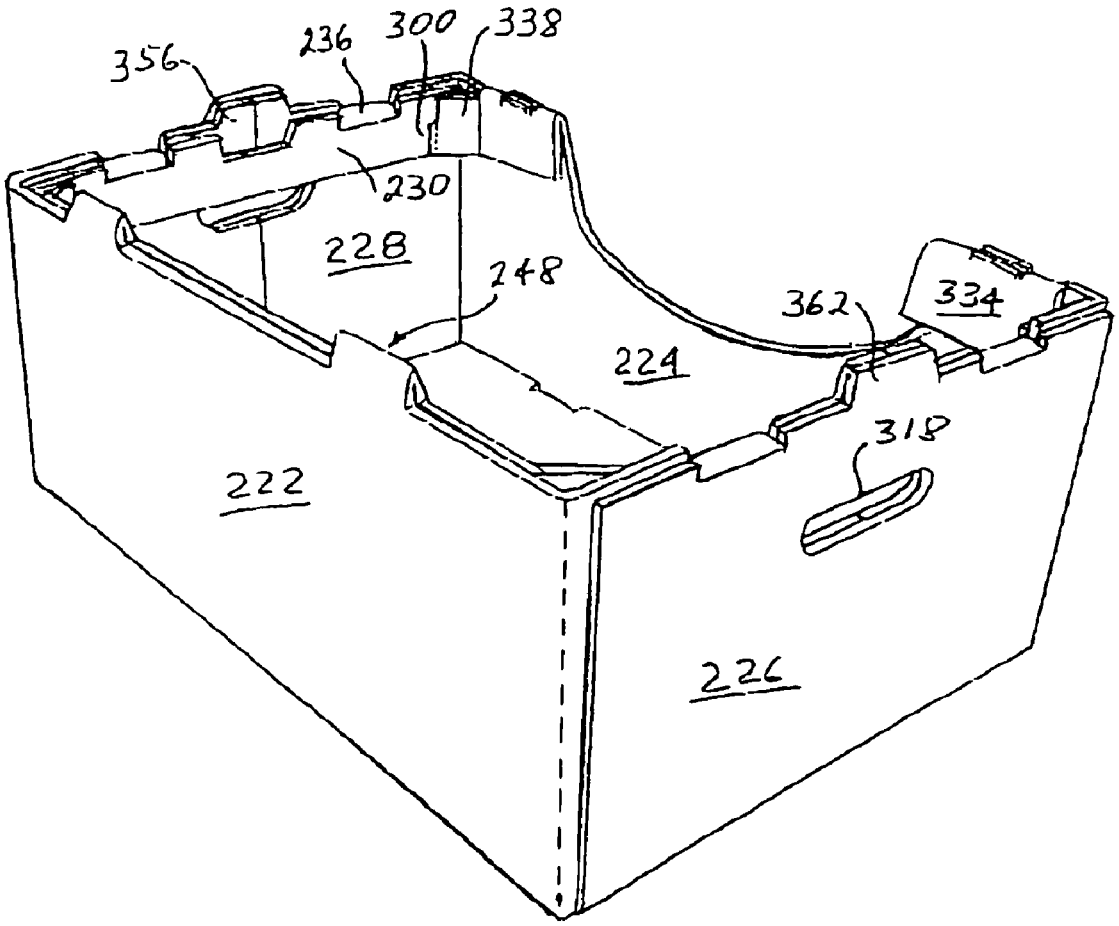
FIG. 7 is a perspective view of a container assembled from the blank of FIG. 4.

A blank for forming an alternative embodiment of the container of FIG. 3 is shown in FIG. 4. A container assembled from the blank of FIG. 4 is shown in FIG. 7. Base panel 220 is substantially rectangular shaped and is bordered by end fold lines 306 and side fold lines 302, 304. Opposing end walls 226 foldably connect to the base panel 220 along fold lines 306. Side wall 222 foldably connects to the base panel 220 along fold line 302 while opposing side wall 224 foldably connects to the base panel along fold line 304. As seen in FIG. 7, when the blank is assembled, the folded down lock flap 230 holds the container together while the folded down reinforcement flap creates a partial top structure that reinforces the container and enables the doubled tabs 248 project upwards from the side wall 222.

The base panel has a tongue 348 positioned along the fold line 306. The tongue has a contact edge 354 disposed adjacent and parallel to a tab recess 346 (see below) on the end wall 226. The tongue has cuts 350, 352 that respectively run perpendicularly and inwards from each end of the contact edge 354. The cuts 350, 352 allow the tongue 348 to pivot up and down and hold an end tab 362 and upper tab 356 (see below) of a sub-adjacent container in place.

The end walls 226 are generally rectangular shaped and each end wall is bordered on four sides by an upper edge 312, fold line 306, and end edges 324. Preferably, end walls 226 have an opening 318 that is similar to and which function in largely the same manner as opening 166 of FIG. 2. The end walls 226 have an end tab 362 extending from upper edge 312. The end walls 226 also have a tab recess 346 along the bottom edge thereof, (i.e., adjacent to the fold line 306), adjacent to the contact edge 354 of the tongue 348 (see above). The tab recess 346 allows the end wall to accept an end tab and upper tabs of a sub-adjacent container.

Side wall 222 is substantially rectangular shaped and bordered by an upper edge 308, fold line 302 and fold lines 280. Side wall 224 is substantially rectangular and bordered by an upper edge 310, fold line 304 and fold lines 280. Side wall 224 has a large, clamshell shaped window recess 332 along the upper edge 310. Side wall 224 also has a reinforcement piece 334 adjacent to each end of the window recess 332 along the upper edge 310 of side wall 224. The reinforcement piece 334 is similar to and functions in largely the same manner as the reinforcement piece 194 in FIG. 3. The reinforcement piece 334 is foldably connected to the upper edge 310 along a perforated fold line 310. The reinforcement piece 334 further has a corner post 338 foldably attached along fold line 340. The reinforcement piece 338 may also have a lock tab 342. The corner post 338 and lock tab 342 are similar to and function in largely the same manner as the corner post 198 and lock tab 202 of FIG. 3. That is, when the blank is assembled, corner post 338 extends diagonally from the reinforcement piece 334 to an adjacent locking flap 230 (see below) and the lock tab 342 fits into an adjacent lock notch 300 (see below). In an alternative embodiment, side wall 224 may be replaced with a side wall similar to side wall 222 such that the erected container has no windows on any side wall and a reinforcement flap on the upper edge of both side walls.

Side walls 222 and 224 have a width about equal to or greater than the width of the upper edge 312 of the end walls 226. The length (arrow L5) of side walls 222, 224 corresponds to the height of the side walls in an erected container. The length (arrow L6) of the end walls 226 corresponds to the height of the end walls of the erected container. Ideally the height of the end walls 226 is the same as the height of side walls 222, 224. Preferably, the width of the upper edge 312 of the end wall 226 is slightly less than the width of a bottom portion of the end wall adjacent to fold line 306 so as to accommodate the taper of side walls 222, 224 when the blank is assembled. In an alternate embodiment, the side walls 202, 204 may have a crushed area similar to and which functions in largely the same manner as the crushed area 124 in FIG. 2.

Side flaps 228 foldably attach to the side walls 222, 224 along fold lines 280. The side flaps 228 are similar to and function in largely the same manner as the end flaps 16 in FIG. 1. The side flaps 228 are substantially rectangular shaped and bordered on four sides by a top edge 276, end edge 320, bottom edge 278, and fold line 280. The upper edge 276 has a lock recess 328. Preferably, side flaps 228 have a bottom tab 282 projecting from the bottom edge 278, the bottom tab 282 being positioned to fit into a flap tab slot 284 located on the base panel 220 adjacent to fold line 306. The side flap may also have a recess 322 along the end edge 320 thereof. The lock recess 328, bottom tab 282, tab slot 284 and recess 322 are similar to and function in largely the same manner as the lock recess 18, bottom tab 54, tab slot 56 and recess 77 in FIG. 1. Preferably, the lock recess has a recess notch 360 in a bottom corner nearest to the fold line 280.

The side flap 228 also has an upper tab 356 extending from the top edge 276, adjacent to the end edge 320. Preferably, the upper flap tab 356 is immediately adjacent to the end edge 320 so that the end edge forms one edge of the upper tab. The side flap 228 also has a flap notch 358 along the bottom edge 278, adjacent to the end edge 320. The upper flap tab 320 is positioned and dimensioned to fit into a corresponding flap notch of a super-adjacent container while the flap notch 358 is positioned and dimensioned to accept the upper tab of a sub-adjacent container.

Similar to end flap 16 of FIG. 1, the bottom edge 278 of side flaps 228 extend generally in the same lateral plane as a bottom end of the side walls except that the bottom edge diverges from the bottom edge of the side walls 222, 224 (i.e., fold lines 302, 304 respectively) with a slight angle towards the top edge 276, thereby causing side walls 222, 224 to taper inwards when the container is assembled. The angle of divergence of the bottom edge 278 can vary greatly, depending on how much of a taper is ultimately desired in the side walls 222, 224. Similarly, top edge 276 extends generally in the same lateral plane as the upper edge 308, 310 of side wall 222 and 224 respectively, except that the top edge diverges away from the upper edges 308, 310 at a slight divergent angle. As in end flap 16, the angle of divergence of the top edge 276 is preferably about the same as the angle of divergence of the bottom edge 278 to allow the upper edge 308, 310 and top edge 276 to create a flat, even top corner when the container is assembled.

The locking flaps 230 are similar to and function in largely the same manner as the locking flaps 20 in FIG. 1. Each locking flap 230 is hingeably connected to the upper edge 312 of end walls 226 by a pair of spaced-apart lock hinge assemblies 234. The lock hinge assembly 234 comprises a hinge 236, hinge cuts 238, 240 and fold lines 242, 244. Preferably, the locking flap 230 has a lock notch 300 along an outer edge 330 thereof. The locking flap 230 may also have a recess 326 along an outer edge 330. The lock hinge assembly 234, hinge 236, hinge cuts 238, 240, fold lines 242, 244, recess 326 and lock notch 300 are similar to and function in largely the same manner as the hinge assemblies 102 hinge 105, hinge cuts 104, 106, fold lines 108, 110, recess 174 and lock notch 152 in FIG. 2. The locking flap 230 also has an end tab recess 364 positioned along the lower edge 232 thereof and directly adjacent to the end tab 362. The end tab recess 364 allows the adjacent end tab 362 and adjacent upper tabs 356 to pass through the locking flap 22 when the locking flap 230 is folded downwards as the blank is assembled.

The reinforcement flap 246 is foldably attached to the upper edge 308 of side wall 222 and is similar to and functions in largely the same manner as the reinforcement flap 112 in FIG. 2. The reinforcement flap 246 has corner posts 286 foldably attached on fold lines 316 along the shorter ends of the reinforcement flap. Preferably, each corner post has a lock tab 290. The corner post 286 and lock tab 290 are similar to and function in largely the same manner as the corner posts 148 and lock tabs 150 in FIG. 2.

The reinforcement flap 246 is connected to the upper edge 308 of the side wall 22 by a pair of spaced-apart doubled tabs 248. However, it is to be understood that a reinforcement flap connected to the upper edge by one or more than two doubled tabs is within the spirit of the present invention. The doubled tab 248 comprises a flap tab 250 extending from a tab edge 314 and a side wall tab 252 extending from the upper edge 308. The two tabs 250, 252 are foldably connected along a tab fold 260. The doubled tabs 248, flap tab 250, side wall tab 252 and tab fold 260 are similar to and function in largely the same manner as the doubled tab 114, flap tab 116, side wall tab 118 and tab fold 120 in FIG. 2.

In a preferred embodiment, tab lock assemblies 262 are cut and scored in the base panel 220 at a location adjacent to fold lines 302, 304 as shown in FIG. 4 or, alternatively, spaced slightly inward from the fold lines 302, 304. The tab lock assembly 262 comprises a stacking slot 264 and a tab flap 266. The tab flap tab 266 is bordered by a contact edge 268, back cut 274, and a pair of opposing side cuts 270, 272. The tab lock assembly 262, stacking slot 264, tab flap 266, contact edge 268, back cut 274, and side cuts 270, 272 are similar to and function in largely the same manner as the tab lock assembly 126, stacking slot 122, tab flap 128, contact edge 130, back cut 136 and side cuts 132, 134 previously discussed above with respect to FIG. 2.

The blank is erected manually to form the container in the largely the same manner as the blank of FIG. 2. The end walls 226 are folded upwards along fold lines 306. The side flaps 228 are folded upwardly along fold lines 280 and the side walls 222, 224 are then folded upwards so that the bottom tabs 282 fit into adjacent tab slots 284, thereby aligning bottom edge 278 with fold line 306. This pulls down the side flaps causing the side walls 222, 224 to taper inwards. The taper of the side walls 222, 224 may be slight, preferably between 1-5°, although this can vary widely within the scope of the invention. The result of the taper is an angle less than 90° between the base panel 220 and the side walls 222, 224.

Each locking flap 230 is folded inwards to lie against an inner surface of adjacent side flaps 228. As the locking flap 230 is folded down, the upper tabs 356 of the adjacent side flaps 228 pass through the end tab recess 364. The folding of the locking flap 230 sandwiches the adjacent side flaps 228 between the locking flap 230 and an adjacent end wall 226 and also cause the hinges 236 to lock into adjacent lock recesses 328.

The reinforcement flap 245 is folded inwards so that the reinforcement flap lies flush against an upper portion of an inner surface of side wall 222 and so that the doubled tabs 248 project upwards from side wall 222. Each corner posts 286 folds along fold line 316 so that the corner post extends diagonally from the reinforcement flap 246 to an adjacent locking flap 230 and the lock tab 290 fits into an adjacent lock notch 300. Since the side wall 222 now tapers inwards, the doubled tabs 248 also taper inwards. Each reinforcement piece 334 is folded downwards and inwards along fold line 336 to lie against an upper portion of the inner surface of the side wall 224. The corner post 338 folds along fold line 310 so that the corner post extends diagonally from the reinforcement piece 334 to an adjacent locking flap 230 and the lock tab 342 fits into an adjacent lock notch 300.

Figure 5:
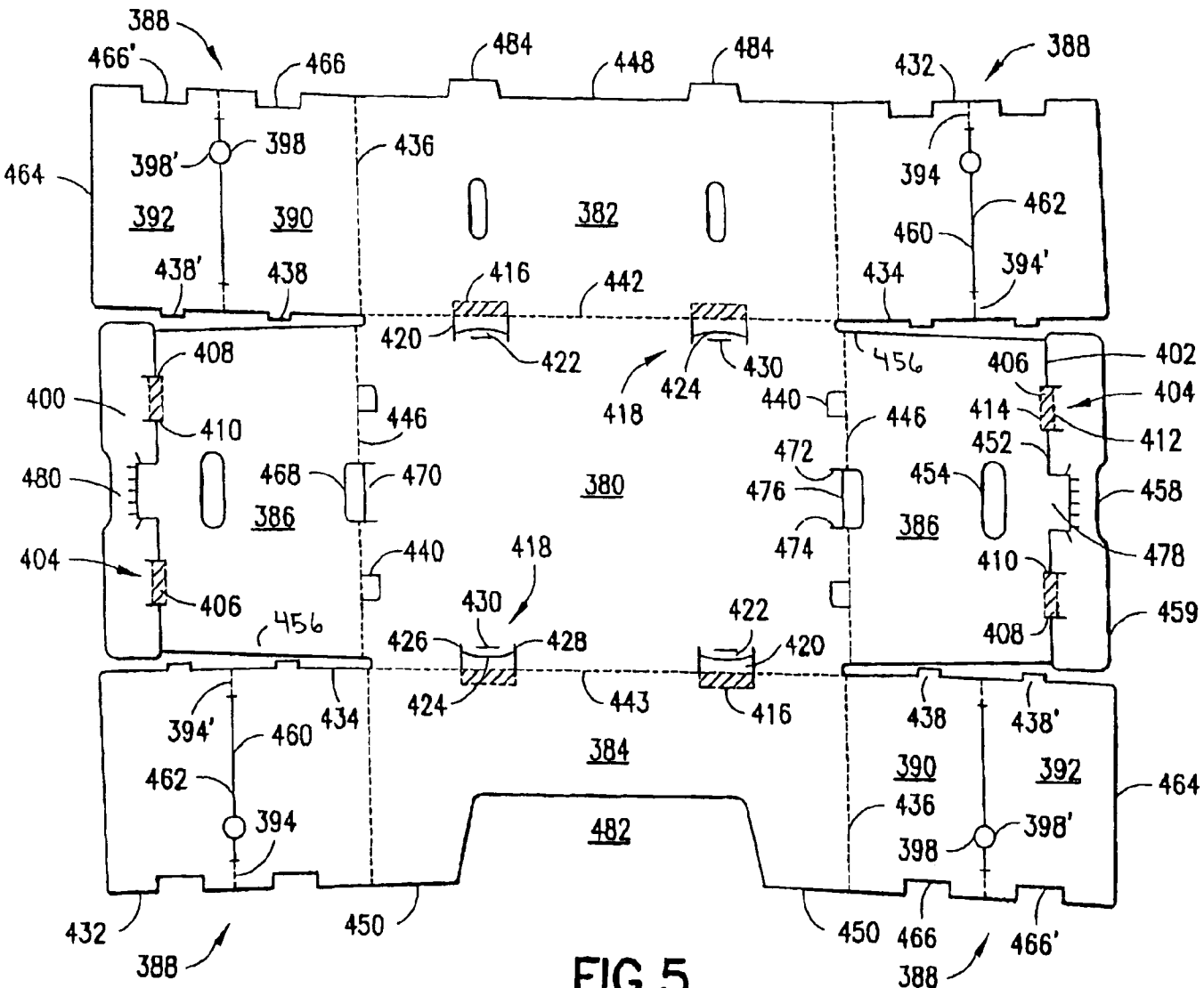
FIG. 5 is a plan view of a blank for a container according to a further embodiment of the present invention.

A blank for forming another embodiment of a container of embodying features of the present invention is FIG. 5. The container erected from the blank has tapering opposing side walls wherein one side wall has a window. Base panel 380 is substantially rectangular shaped and is bordered by end fold lines 436 and side fold lines 442, 443. Opposing end walls 386 foldably connect to a base panel 380 along fold lines 446. Side wall 382 foldably connects to the base panel 380 along fold line 442 while side wall 384 foldably connects to the base panel along fold line 443.

The base panel 330 has a tongue 470 positioned along fold lines 446. The tongue has a contact edge 476 disposed adjacent and parallel to a tab recess 468 (see below) on the end wall 386. The tongue has cuts 472, 474 that respectively run perpendicularly and inwards from each end of the contact edge 476. The cuts 472, 474 allow the tongue 470 to pivot up and down and hold an end tab 478 (see below) of a sub-adjacent container in place.

The end walls 386 are generally rectangular shaped and each end wall is bordered on four sides by an upper edge 402, fold line 446, and end edges 456. Preferably, the end walls have an opening 454 that is similar to and which functions in largely the same manner as the opening 166 in FIG. 2. Each end wall has an end tab 478 extending from the upper edge 452. Also, each end wall has a tab recess 468 along the bottom edge thereof, (i.e., adjacent to the fold line 446), adjacent to the contact edge 476 of the tongue (see above). The tab recess 468 allows the end wall to accept an end tab of a sub-adjacent container.

Side wall 382 is substantially rectangular shaped and bordered by an upper edge 448, fold line 442 and fold lines 436. A pair of spaced apart side wall tabs 484 project outwards from the upper edge 448 of the side wall 382. The side wall tabs 484 are dimensioned to fit into a stacking slot (see below) of a super-adjacent container.

Side wall 384 is substantially rectangular shaped and bordered by an upper edge 450, fold line 443 and fold lines 436. Side wall 384 has a generally rectangular shaped window recess 482 along the upper edge 450. The side walls 382, 384 have a width about equal to or greater than the width of the upper edge 452 of the end walls 386. The length of the side walls 382, 384 corresponds to the height of the side walls in an erected container. The length of the end walls 386 corresponds to the height of the end walls of the erected container. Ideally the height of the end walls 386 is the same as the height of side walls 382, 384. Preferably, the width of the upper edge 452 of the end walls is slightly less than the width of a bottom portion of the end walls adjacent to fold line 446 so as to accommodate the taper of side walls 382, 384 when the blank is assembled. The side walls may have a crushed area 416 similar to and which functions in largely the same manner as the crushed area 124 in FIG. 2.

Side flaps 388 foldably attach to side walls 382, 384 along fold lines 436. The side flaps 388 are substantially rectangular shaped and bordered on four sides by a top edge 432, end edge 464, bottom edge 434 and fold line 436. Each side flap 338 comprises an inner flap 390 and an outer flap 392. The inner flap 390 is substantially rectangular shaped and bordered on four sides by the top edge 432, bottom edge 434, fold line 436 and inner edge 460. The outer flap 392 is substantially rectangular shaped and bordered on four sides by the top edge 432, bottom edge 434, end edge 464 and inner edge 462. The inner flap 390 is foldably connected to the outer flap 392 along the inner edge 460 and inner edge 462 of the inner flap and outer flap respectively, preferably, by a pair of flap hinges 394, 394'. One flap hinge 394 is disposed immediately adjacent to the top edge 432 of the side flap while the other flap hinge 394' is disposed immediately adjacent to the bottom edge 434 of the side flap.

The inner flap has a lock recess 466 along the top edge 432 and, preferably, a bottom tab 438 projecting from the bottom edge 434. Further, the inner flap may have a recess 398 along the inner edge 460. The outer flap 392 has a lock recess 466' along the top edge 432 and, preferably, a bottom tab 438' projecting from the bottom edge 434. Further, the outer flap 392 may have a recess 398' along the inner edge 462. The bottom tabs 438, 438' are positioned and dimensioned to fit into a tab slot 440 that is disposed on the base panel 380 at a position adjacent to fold line 446. The lock recesses 466, 466', bottom tabs 438, 438', tab slot 440 and recesses 398, 398' are similar to and function largely in the same manner as the lock recess 176, bottom tab 144, tab slot 146 and recess 170 in FIG. 2.

Similar to end flap 16 of FIG. 1, the bottom edge 434 of the side flaps 388 extend generally in the same lateral plane as fold lines 442, 443 except that the bottom edge diverges from a bottom edge of the side walls 382, 384 (i.e., fold lines 442, 443, respectively) with a slight angle towards the top edge 432, thereby causing the side walls 382, 384 to taper inwards when the container is assembled. The angle of divergence of the bottom edge 434 can vary greatly, depending on how much of a taper is ultimately desired in the side walls 382, 384. Similarly, the top edge 432 of the side flaps extend generally in the same lateral plane as the upper edge 448 and 450 of side walls 382 and 384 respectively, except that the top edge diverges away from the upper edges 308, 310 at a slight divergent angle. As in end flap 16, the angle of divergence of the top edge 432 is preferably about the same as the angle of divergence of the bottom edge 434 to allow the upper edges 448, 450 and top edge 432 to create a flat, even top corner when the container is assembled.

The locking flaps 400 are similar to and function in largely the same manner as the locking flaps 98 in FIG. 2. Each locking flap 400 is hingeably connected to the upper edges 452 of the end wall 386 by a pair of spaced-apart lock hinge assemblies 404. The lock hinge assemblies comprise a hinge 406, hinge cuts 408, 410 and fold lines 412, 414. The locking flap may have a recess 458 along an outer edge 459. The lock hinge assembly 404, hinge 406, hinge cuts 408, 410, fold lines 412, 414 and recess 458 are similar to and function in largely the same manner as the hinge assemblies 102, hinge 105, hinge cuts 104, 106, fold lines 108, 110 and recess 174 in FIG. 2. The locking flap 400 also has an end tab recess 480 positioned along the lower edge 402 thereof and directly adjacent to the end tab 478. The end tab recess 480 enables the locking flap 400 to be folded down without interfering with the end tab 478, thereby allowing the end tab to project upwards when the blank is assembled.

Preferably, tab lock assemblies 418 are cut and scored in the base panel 380 at a location adjacent to fold line 442 as shown in FIG. 5 or, alternatively, spaced slightly inward from the fold line 442. Each tab lock assembly 262 comprises a stacking slot 420 and a tab flap 422. The tab flap 422 is bordered by a contact edge 424, back cut 430, and a pair of opposing side cuts 426, 428. The tab lock assembly 418, stacking slot 420, tab flap 422, contact edge 424, back cut 430, and side cuts 426, 428 are similar to and function in largely the same manner as the tab lock assembly 126, stacking slot 122, tab flap 128, contact edge 130, back cut 136 and side cuts 132, 134 in FIG. 2. Preferably, as shown in FIG. 5, tab lock assemblies 418 are also cut and scored in the base panel 380 at a location adjacent to fold line 443 as shown in FIG. 5 or, alternatively, spaced slightly inward from the fold line 443. This is advantageous as it allows one container to stack on top of another container (i.e., a sub-adjacent container) even if the north-south orientation of container is opposite from the sub-adjacent container.

The blank is erected manually to form the container in the largely the same manner as the blank of FIG. 2. The end walls 386 are folded upwards along fold lines 446. The outer flap 392 is folded inwards along the flap hinges 394, 394' so that the outer flap lies flush against an inner surface of the inner flap 390. Consequently, the lock recess 466', recess 398' and bottom tab 438' of the outer flap 392 register respectively with the lock recess 466, recess 398 and bottom tab 438 of the inner flap 390. The resulting folded side flaps 388 are folded upwardly along fold lines 436 and the side walls 382, 384 are then folded upwards to so that the bottom tabs 438. 438' fit into adjacent tab slots 440, thereby aligning bottom edge 434 with end fold line 446. This pulls down the side flaps, causing the side walls 382, 384 to taper inwards. The taper of the side walls 382, 384 may be slight, preferably between 1-5°, although this can vary widely within the scope of the invention. The result of the taper is an angle less than 90° between the base panel 380 and side walls 382, 384. Each locking flaps 400 is folded inwards to lie against an inner surface of adjacent folded side flaps 388. The locking flap 400 sandwiches the adjacent folded side flaps 388 between the locking flap and an adjacent end wall 386 and also cause the hinges 406 to lock into adjacent lock recesses 466, 466'.

Figure 6:
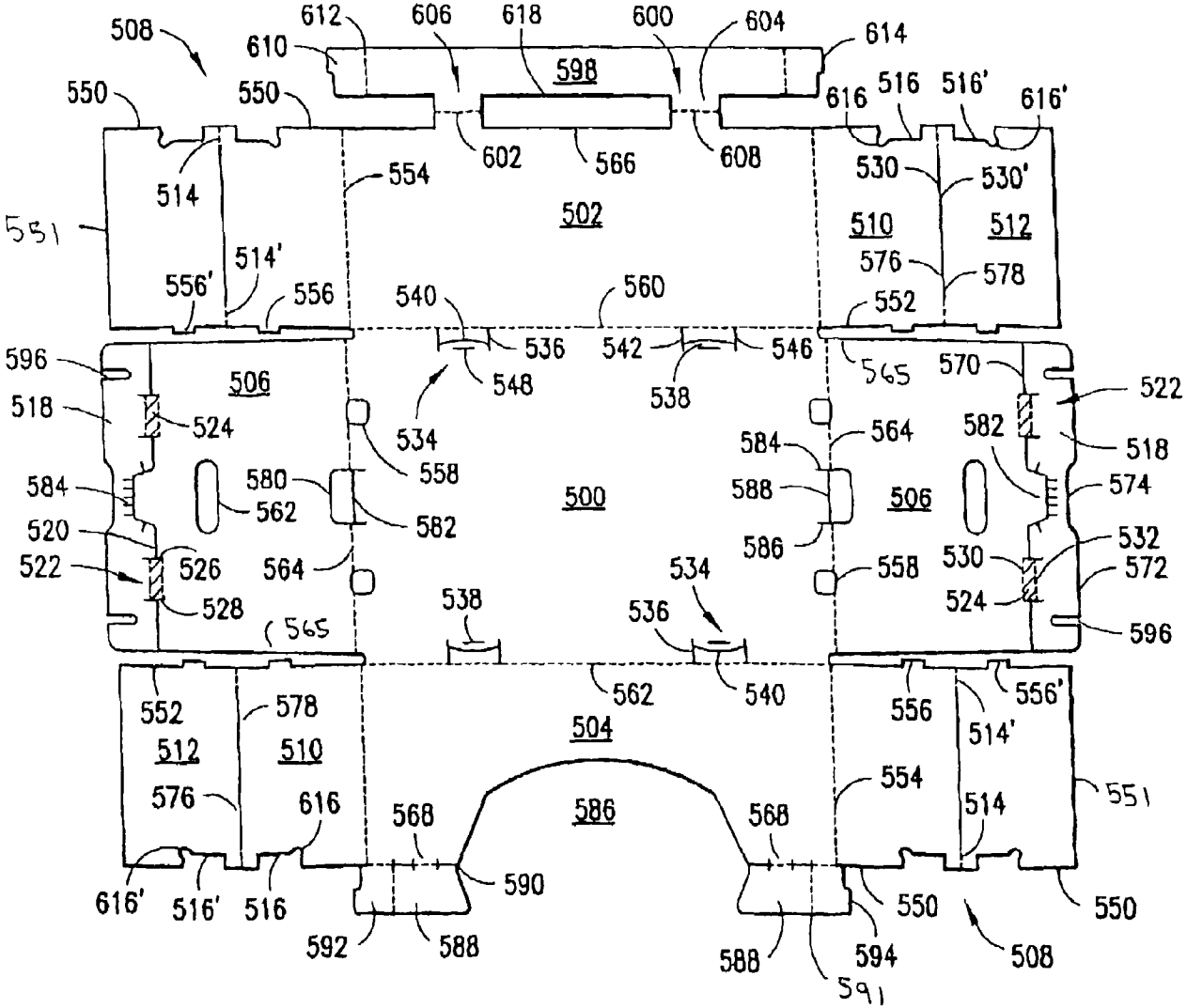
FIG. 6 is a plan view of a blank for a container according to another embodiment of the present invention.

A blank for forming another embodiment of a container of embodying features of the present invention is shown in FIG. 6. The container erected from the blank has tapering opposing side walls wherein one side wall has a window and reinforcement pieces and the other side wall has a reinforcement flap. Base panel 500 is substantially rectangular shaped and is bordered by fold lines 564 and fold lines 442, 443. Opposing end walls 506 foldably connect to the base panel 500 along fold lines 564. Side wall 502 foldably connects to the base panel 500 along fold line 560 while side wall 504 foldably connects to the base panel 500 along fold line 562.

The base panel 500 has a tongue 582 positioned along the end fold line 564. The tongue has a contact edge 588 disposed adjacent and parallel to a tab recess 580 (see below) located on the end wall 506. The tongue has cuts 584, 586 that respectively run perpendicularly and inwards from each end of the contact edge 588. The cuts 584, 586 allow the tongue 470 to pivot up and down and hold an end tab (see below) of a sub-adjacent container in place.

The end walls 506 are generally rectangular shaped and each end wall is bordered on four sides by an upper edge 579, fold line 564, and end edges 565. Preferably, the end wall has an opening 562 that is similar to and which functions in largely the same manner as the opening 166 in FIG. 2. Each end wall has also an end tab 582 extending from the upper edge 570. Also, each end wall has a tab recess 580 along the bottom edge thereof, (i.e., adjacent to the fold line 446), adjacent to the contact edge 588 of the tongue 582 (see above). The tab recess allows the end wall to accept an end tab of a sub-adjacent container.

Side wall 502 is substantially rectangular shaped and bordered by an upper edge 566, side fold line 560 and fold lines 554. A reinforcement flap 598 is connected to the upper edge 566 of the side wall 502 by a pair of spaced-apart doubled tabs 600. However, it is to be understood that a reinforcement flap connected to the upper edge by one or more than two doubled tabs is within the spirit of the present invention. The doubled tab 600 comprises a flap tab 604 extending from a tab edge 618 and a side wall tab 602 extending from the upper edge 566 of the side wall. The two tabs 602, 604 are foldably connected along a tab fold 608. The doubled tab 600, flap tab 604, side wall tab 602 and tab fold 608 are similar to and function in largely the same manner as the doubled tab 114, flap tab 116, side wall tab 118 and tab fold 120 in FIG. 2.

Side wall 504 is substantially rectangular shaped and bordered by an upper edge 568, fold line 562 and fold lines 554. Side wall 504 has a large, generally clamshell shaped window recess 586 along the upper edge 568. In an alternative embodiment, the side wall 224 may be replaced with a side wall similar to side wall 222 such that the erected container has no windows on any side wall and a reinforcement flap on the upper edges of both side walls.

Reinforcement pieces 588 are attached to the upper edge 568 of side wall 504 at adjacent to each end of the window recess 586. The reinforcement piece 588 is similar to and functions in largely the same manner as the reinforcement piece 194 in FIG. 3. The reinforcement piece 588 is foldably connected to the upper edge along a perforated fold line 590. The reinforcement piece has a corner post 592 foldably attached along fold line 591. Preferably, the reinforcement piece 338 also has a lock tab 594. The corner post 592 and lock tab 594 are similar to and function in largely the same manner as the corner post 198 and lock tab 202 in FIG. 3.

The side walls 502, 504 have a width about equal to or greater than the width of the upper edge 570 of the end walls 506. The length of the side walls 502, 504 corresponds to the height of the side walls in an erected container. The length of the end walls 506 corresponds to the height of the end walls of the erected container. Ideally the height of the end walls 506 is the same as the height of side walls 502, 504. Preferably, the width of the upper edge 570 of the end walls is slightly less than the width of a bottom portion of the end walls adjacent to the fold line 564. This is to accommodate the taper of side walls 502, 504 when the blank is assembled. In an alternate embodiment, the side walls may have a crushed area similar to and which functions in largely the same manner as the crushed area 124 in FIG. 2.

Side flaps 508 foldably attach to the side walls 502, 504 along fold lines 554. The side flaps 508 are similar to and function in largely the same manner as the side flaps in 388 in FIG. 5. The side flaps 508 are substantially rectangular shaped and bordered on four sides by a top edge 550, end edge 551, bottom edge 552 and fold line 554. Each side flap 508 comprises an inner flap 510 and an outer flap 512. The inner flap 510 is substantially rectangular shaped and bordered on four sides by the top edge 550, bottom edge 552, fold line 554 and inner edge 576. The outer flap 312 is substantially rectangular shaped and bordered on four sides by the top edge 550, bottom edge 552, end edge 551 and inner edge 578. The inner flap 510 is foldably connected to the outer flap 512 along inner edge 578 and inner edge 576 of the inner flap 510 and outer flap 512 respectively, preferably, by a pair of flap hinges 514, 514'. One flap hinge 514 is disposed immediately adjacent to the top edge 550 of the side flap while the other flap hinge 514' is disposed immediately adjacent to the bottom edge 552 of the side flap.

The inner flap has a lock recess 516 along the top edge 550 and, preferably, a bottom tab 556 projecting from the bottom edge 552. The outer flap has a lock recess 516' along the top edge 550 and, preferably, a bottom tab 556' projecting from the bottom edge 552. The bottom tabs 556, 556' are dimensioned to fit into a tab slot 558 disposed on the base panel 500 adjacent to fold line 564. The lock recesses 516, 516', bottom tabs 556, 556' and tab slot 558 are similar to and function largely in the same manner as the lock recesses 466, 466', bottom tabs 438, 438' and tab slot 440 in FIG. 5. The lock recesses 516, 516' may respectively have a recess notch 616, 616' at the corner that would be adjacent to the fold line 554 when the side flap 508 is folded inwards (see below).

Similar to end flap 16 of FIG. 1, the bottom edge 552 of the side flaps 508 extend generally in the same lateral plane as fold line 560, 562 except that the bottom edge diverges from the bottom edges of the side walls 502, 504 (i.e., fold line 560, 562 respectively) with a slight angle towards the top edge 550, thereby causing side walls 502, 504 to taper inwards when the container is erected. The angle of divergence of the bottom edge 552 can vary greatly, depending on how much of a taper is ultimately desired in the side walls. Similarly, the top edge 550 of the side flaps extend generally in the same lateral plane as the upper edges 566, 568 of side walls 502, 504 respectively, except that the top edge diverges away from the upper edges 566, 568 at a slight divergent angle. As in end flap 16, the angle of divergence of the top edge 550 is preferably about the same as the angle of divergence of the bottom edge 552 to allow the upper edges 566, 569 and top edge 550 to create a flat, even top corner when the container is assembled.

The locking flaps 518 are similar to and function in largely the same manner as the locking flaps 98 in FIG. 2. Each locking flap is hingeably connected to the upper edge 570 of the end walls by a pair of spaced-apart lock hinge assemblies 522. The lock hinge assemblies comprise a hinge 524, hinge cuts 526, 528 and fold lines 530, 532. The locking flap may have a recess 574 along an outer edge 572. Preferably, the locking flap also has a pair of lock notches 596 disposed along the outer edge 572. The lock hinge assembly 522, hinge 524, hinge cuts 526, 528, fold lines 530, 532 and recess 574 are similar to and function in largely the same manner as the hinge assemblies 102, hinge 105, hinge cuts 104, 106, fold lines 108, 110, recess 174 and lock notches 152 in previously discussed above with respect to FIG. 2. The locking flap also has an end tab recess 584 positioned along the lower edge 570 thereof and directly adjacent to the end tab 582. The end tab recess enables the locking flap to be folded down without interfering with the end tab 584, thereby allowing the end tab to project upwards when the blank is assembled.

Tab lock assemblies 534 are cut and scored in the base panel 500 at a location adjacent to fold line 560 as shown in FIG. 6 or, alternatively, spaced slightly inward from the fold line 560. Each tab lock assembly comprises a stacking slot 536 and a tab flap 538. The tab flap 538 is bordered by a contact edge 540, back cut 548, and a pair of opposing side cuts 542, 546. The tab lock assembly 534, stacking slot 540, tab flap 538, contact edge 540, back cut 548, and side cuts 542, 546 are similar to and function in largely the same manner as the tab lock assembly 126, stacking slot 122, tab flap 128, contact edge 130, back cut 136 and side cuts 132, 134 in FIG. 2. Preferably, as shown in FIG. 5, tab lock assemblies 534 are also cut and scored in the base panel 500 at a location adjacent to fold line 562 as shown in FIG. 6 or, alternatively, spaced slightly inward from the fold line 562. This is advantageous as it allows one container to stack on top of another container (i.e., a sub-adjacent container) even if the north-south orientation of the container is opposite from that of the sub-adjacent container.

The blank is erected manually to form the container in the largely the same manner as the blank of FIG. 5. The end walls 506 are folded upwards along fold lines 564. Each outer flap 512 is folded inwards along the flap hinges 514, 514' so that the outer flap lies flush against an inner surface of the inner flap 510. Consequently, the lock recess 516', bottom tab 556' and recess notch 616' of the outer flap 512 register respectively with the lock recess 516, bottom tab 556 and recess notch 616 of the inner flap 510.

The resulting folded side flaps 508 are folded upwards along fold lines 554 and then the side walls 502, 504 are folded upwards along fold lines 560, 562 respectively so that the bottom tabs 556, 556' fit into adjacent tab slots 558, thereby aligning bottom edge 552 with end fold line 564. This pulls down the side flaps causing the side walls 502, 504 to taper inwards. The taper of the side walls 502, 504 may be slight, preferably between 1-5°, although this can vary widely within the scope of the invention. The result of the taper is an angle less than 90° between the base panel 500 and the side walls 502, 504.

Each locking flap 518 is folded inwards to lie against an inner surface of an adjacent folded side flap 508. The locking flap 518 sandwiches adjacent folded side flaps 508 between the locking flap and an adjacent end wall 506 and also cause the hinges 524 to lock into adjacent lock recesses 516, 516'. The reinforcement flap 598 is folded inwards to lie flush against an upper inner surface of side wall 502. This causes the doubled tabs 600 to project upwards from the top of the container. Each corner post 610 is folded along fold line 612 so that the corner post extends diagonally to an adjacent locking flap 518 and the lock tab 614 fits into an adjacent lock slot. Similarly, each reinforcement piece 588 is folded inwards to lie against an inner surface of an upper portion of side wall 504. Each corner post 592 is folded along fold line 591 so the that corner post 592 extends diagonally towards an adjacent locking flap 518 and the lock tab 594 fits into an adjacent lock slot. 596.

Although the invention has been described with reference to preferred embodiments, it will be appreciated by one of ordinary skill in the art that numerous modifications are possible in light of the above disclosure. For example, the doubled tabs, end tabs, side wall tabs and window recesses may be of different shapes than those depicted in the drawings without departing from the spirit of the invention. Further, although the embodiments in FIG. 1-6 show rectangular shaped containers, it is to be understood that square or cube shaped containers are within the spirit of the present invention. All such variations and modifications are intended to be within the scope and spirit of the invention as defined in the claims appended hereto.

The invention claimed is:

1. A container formed from a blank, the container comprising:

a base panel;

two opposing side walls connected to the base panel at substantially a 90° angle;

two opposing end walls connected to the base panel at an angle less than 90°, the end walls having a width equal or less than the width of upper edges of the side walls, each end wall having an end flap connected to opposing sides of the end wall, each end flap having a lock recess disposed along a top edge of thereof;

locking flaps connected to the side walls by at least one pair of lock hinge assemblies, wherein each locking flap folds inwardly to sandwich adjacent said end flaps between the locking flap and an adjacent said side wall and further, wherein each locking hinge assembly locks into the lock recess of the adjacent end flap; and a reinforcement flap connected to at least one of said end walls by at least one doubled stacking tab, wherein the reinforcement flap lies flush against an inner surface of the at least one of said end walls, wherein the base panel further comprises at least one stacking slot cut into the base panel, the at least one stacking slot positioned to accept the at least one doubled stacking tab extending from an angled end wall of a sub-adjacent container;

the at least one stacking slot is positioned adjacent to the at least one end wall; and the at least one end wall has a first thickness and further comprises a crushed area, the crushed area having a second thickness, the second thickness being less than the first thickness, wherein a bottom of the crushed area is adjacent to the at least one stacking slot.

2. The container according to claim 1, further comprising a tab flap disposed on the base panel adjacent to the at least one stacking slot, the flap having a contact edge disposed adjacent and parallel to the at least one stacking slot.

3. The container according to claim 1, wherein the end flap has a bottom edge that angles divergently upward from a bottom edge of an adjacent said end wall.

4. The container according to claim 1, wherein the reinforcement flap has corner flaps attached to opposing side edges thereof, and further wherein each corner flap extends diagonally towards an adjacent said locking flap.

5. The container according to claim 4, wherein the locking flap has at least one lock slot disposed along an outer edge thereof, a lock tab projects from a side edge of the corner flap and further, wherein the lock tab extends into said at least one lock slot.

6. The container according to claim 1, wherein a bottom tab projects from a bottom edge of at least one said end flap, at least one tab slot is disposed on the base panel adjacent to at least one of said side walls and further, wherein the bottom tab extends into the at least one tab slot.

7. A container formed from a blank, the container comprising:

a base panel;

two opposing side walls connected to the base panel at substantially a 90° angle;

two opposing end walls connected to the base panel at an angle less than 90°, the end walls having a width equal or less than the width of upper edges of the side walls, each end wall having an end flap connected to opposing sides of the end wall, each end flap having a lock recess disposed along a top edge of thereof;

locking flaps connected to the side walls by at least one pair of lock hinge assemblies, wherein each locking flap folds inwardly to sandwich adjacent said end flaps between the locking flap and an adjacent said side wall and further, wherein each locking hinge assembly locks into the lock recess of the adjacent end flap; and a reinforcement flap connected to at least one of said end walls by at least one doubled stacking tab, wherein the reinforcement flap lies flush against an inner surface of the at least one of said end walls, wherein the reinforcement flap has corner flaps attached to opposing side edges thereof, and further wherein each corner flap extends diagonally towards an adjacent said locking flap.

8. The container according to claim 7, wherein the base panel further comprises at least one stacking slot cut into the base panel, the at least one stacking slot positioned to accept the at least one doubled stacking tab extending from an angled end wall of a sub-adjacent container.

9. The container according to claim 8, wherein the at least one stacking slot is positioned adjacent to the at least one end wall.

10. The container according to claim 9, further comprising a tab flap disposed on the base panel adjacent to the at least one stacking slot, the flap having a contact edge disposed adjacent and parallel to the at least one stacking slot.

11. The container according to claim 7, wherein the end flap has a bottom edge that angles divergently upward from a bottom edge of an adjacent end wall.

12. The container according to claim 7, wherein the locking flap has at least one lock slot disposed along an outer edge thereof, a lock tab projects from a side edge of the corner flap and further, wherein the lock tab extends into at least one lock slot.

13. The container according to claim 7, wherein a bottom tab projects from a bottom edge of at least one end flap, at least one tab slot is disposed on the base panel adjacent to the side wall and further, wherein the bottom tab extends into the at least one tab slot.

* * * * *